United States Patent [19]

Klubitschko

[11] Patent Number: 4,657,278

[45] Date of Patent: Apr. 14, 1987

[54] STEP-IN ELECTRONIC SAFETY SKI BINDING

[76] Inventor: Gerd Klubitschko, Daisenbergstrasse 12, 8106 Oberau, Fed. Rep. of Germany

[21] Appl. No.: 442,161

[22] Filed: Nov. 16, 1982

[30] Foreign Application Priority Data

Nov. 23, 1981 [DE] Fed. Rep. of Germany ..... 3146318

[51] Int. Cl.[4] ..... A63C 9/00

[52] U.S. Cl. ..... 280/612; 280/632

[58] Field of Search ..... 280/612, 611, 626, 631, 280/632, 618, 616, 634

[56] References Cited

U.S. PATENT DOCUMENTS 3,907,316 9/1975 Markor et al. ..... 280/612
3,919,563 11/1975 Lautier et al. ..... 280/612
4,121,854 10/1978 Cornu ..... 280/612
4,130,296 12/1978 D'Antonio et al. ..... 280/612
4,444,413 4/1984 Richert et al. ..... 280/632

FOREIGN PATENT DOCUMENTS 1810013 5/1970 Fed. Rep. of Germany ..... 280/626
2431307 3/1980 France ..... 280/631

*Primary Examiner*—David M. Mitchell

[57] ABSTRACT

A step-in ski electronic binding having a housing for engaging a ski boot, the housing being moveable between ski boot releasing and latching positions, releasable latching means for releasably latching the housing in its latching position and cocking means for cocking an electrically controlled release actuator when the housing is moved to its latching position.

2 Claims, 26 Drawing Figures

STEP-IN ELECTRONIC SAFETY SKI BINDING

BACKGROUND OF THE INVENTION

The present invention relates to safety ski bindings. Ski bindings latch to grip a ski boot, generally by gripping the edge of the sole at the heel and the toe, and hold it, and the skier whose leg is in the boot, to a ski. A binding is attached by conventional means, such as screws, to a ski. A safety ski binding is designed to release the grip on a ski boot when the skiing forces on the boot and skier's leg exceed some predetermined threshold which threatens the safety of the skier. It is known in the art that the skiing forces exerted on the leg of a skier may be detected mechanically or electronically. See U.S. Pat. No. 4,291,894, issued Sept. 29, 1981 to D'Antonio and Bates. In an electronic safety ski binding, electrical signals corresponding to detected skiing forces are processed electronically to determine if the predetermined threshold is exceeded. If so, an electrical release signal is generated which actuates the mechanical portion of the binding causing the ski boot to be released from the binding.

For convenience in use, it is desirable that a safety ski binding be of the "step-in" type. In that type of binding, the skier cocks the release mechanism by stepping into the binding. Other binding types require extra cocking actions by the skier in addition to stepping into the binding. Some bindings require the throwing of a lever before the binding is ready for use. Electronic safety ski bindings are known which require a skier to cock the release mechanism manually in order to prepare the binding for use.

SUMMARY OF THE INVENTION

A step-in binding is provided in the present invention which is particularly suitable for use with an electronic release system. Various embodiments of an inventive heel piece for a step-in binding are described. The binding heel piece grasps of the sole of a ski boot at the heel of the boot. The various embodiments of the invention described here include a sole plate for mounting on a ski and a housing mounted on the sole plate. A pivoting connection connects the housing to the sole plate and permits movement of the housing between latching and releasing positions for latching a ski boot to the binding and for releasing it from the binding, respectively. The housing, which is mechanically biased toward its releasing position, includes a means for engaging the sole of the ski boot. In the embodiments described here, at least one protrusion on the housing restrains the heel portion of the ski boot toward the ski when the binding is latched. A releasable latching mens latches the housing in its latching position.

A cockable release actuator, when actuated, releases the housing from its latching position to its releasing position. The embodiments of the invention described here are shown with a piston as a release actuator. The piston is retracted or projected upon the generation of an electrical release signal to effect a release. The invention also includes a cocking means cooperating with the latching means for cocking the release actuator when the housing is driven from its releasing position to its latching position by a ski boot. The cocking means, latching means and the release actuator are engaged by the driving force of the boot so that the force latches the binding and cocks the release actuator. Thereby the advantage of a step-in binding in an electronic ski binding is achieved.

One embodiment of the invention includes as part of a latching means a plate depending from the housing and having an aperture or recess for receiving an outwardly biased release actuator that retracts upon receipt of a release signal. Stepping into the binding causes the plate to drive the actuator into a retracted position until it is aligned with the recess. Upon alignment, the actuator seats in the recess, latching the binding. In another embodiment, one end of a lever mounted on the sole plate bears on a release actuator that extends upon actuation. A guide mounted on the housing on which the opposite end of the lever may bear, guides the lever into positions which latch and release the housing, respectively. When a skier steps into a released binding, the guide directs the first end of the lever to the latching position, while the opposite end of the lever arm cocks the release actuator by pushing it into its latching position. Another embodiment includes, in addition to the guide, a stop for ensuring that the first end of the lever travels only in the desired direction with respect to the guide. Still another embodiment includes a doubly hinged linkage that cooperates with a lever that may bear upon and cock the actuator. The lever also transmits the mechanical release of the actuator to the linkage to release the latched binding. Yet another embodiment intended for use in a binding in which the heel piece is sloped, includes a doubly hinged linkage, interconnecting the housing and sole plate, a finger extending from the housing and bearing on the linking, and two interacting levers including a catch and guide for securely latching the binding. The final embodiment of the invention described here includes a resilient hook that is retained by a post. An actuator is projected upon receipt of a release signal and raises the hook off the post, allowing the binding to assume its releasing position. A projection on the rear of the housing engages a finger attached to the actuator during latching of the binding. The movement of the housing to the latching position causes the finger to draw the actuator back into its latching position so that it is cocked. The resilient hook springs over the post during the latching movement of the housing.

DETAILED DESCRIPTION OF PREFERRED EMBODIMENTS

Figure 1:
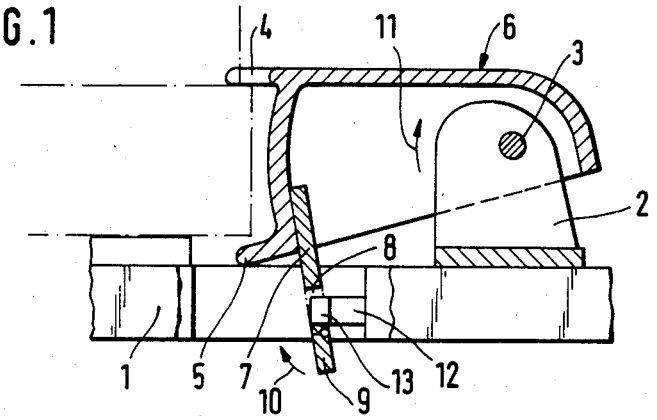
FIG. 1 is a cross sectional side view of an embodiment of a heel piece, according to the invention, in its latching position.

Generally, in a safety ski binding, a toe piece and heel piece are provided for grasping, respectively, the toe and heel portions of the sole of a ski boot. At last one of the pieces may be released and latched to release and grasp a ski boot, respectively. The description that follows concerns only a releasable and latchable heel piece, but it is understood that the complete binding also includes a passive or lockable toe piece.

The heel piece described is particularly useful with an electronic safety ski binding, i.e., one in which the forces acting on a skier's leg are measured by electrical transducers that produce an electrical signal corresponding to each measured force and/or torque. The signals are electronically processed to determine if predetermined threshold values are exceeded so that the sensed forces represent a threat to the safety of a skier. When a threat to skier safety is detected, an electrical release signal is generated which preferably activates an electromechanical device, such as an iron slug slideably mounted within an electrical coil, to cause the heel piece to release its grasp on the ski boot sole. That is, upon generation of a release signal there is a transition in the heel piece from its latching position to its releasing position. However, the invention is not limited to use with electronic ski bindings. The invention may be used with any ski binding which produces a mechanical actuation in response to the detection of forces which are excessive with respect to a predetermined threshold.

A number of embodiments of the invention are described. In all of the figures and the descriptions, like elements of each embodiment are given the same reference numerals.

In FIG. 1 a cross sectional view of an embodiment of a heel piece, according to the invention, is shown in its latching position. A portion of a sole plate 1 is shown in a horizontal position. Sole plate 1 may be mounted on a ski, not shown, by conventional means such as screws. A support 2 mounted on sole plate 1 toward the rear portion of sole plate 1 includes a pivoting transverse axle 3. As used here, transverse refers to a direction across the width of a ski to which sole plate 1 is attached and front and rear refer to the front and rear of a ski on which sole plate 1 is mounted. Axle 3 is fixed to a housing 6 of the heel piece within which the elements of the releasing mechanism are housed. Axle 3 provides a connection means for connecting housing 6 and sole plate 1 so that housing 6 may be pivotally moved between its latching position shown in FIG. 1 and its releasing position shown in FIG. 3. Housing 6 includes two generally parallel protrusions 4 and 5 on its front surface for receiving and engaging the sole of the ski boot. The protrusions engage the heel portion of the sole of a ski boot, shown in broken lines. When housing 6 is in its latching position, protrusion 4 restrains the sole of the ski boot toward sole plate 1. When housing 6 is in its releasing position, protrusion 5 acts as a pedal which is operated by the sole of the ski boot to move housing 6 from its releasing position to its latching position.

Figure 2:
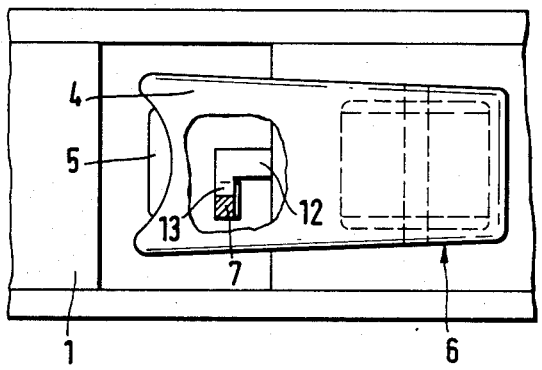
FIG. 2 is a top view, partially sectioned, of an embodiment of a heel piece, according to the invention, in its latching position.

A downwardly extending member such as a plate 7 having a recess or aperture 8, best seen in FIG. 2, is attached to and depends from the inside of housing 6. Opposite the portion of plate 7 attached to housing 6 and beyond recess 8, plate 7 has an extension 9. A housing biasing moment 11 is applied to housing 6 for biasing housing 6 to move toward its releasing position. A spring or other conventional means is used to apply the housing biasing moment. A release actuator 12 having a tip 13 projects from sole plate 1 so that tip 13 engages the wall defining recess 8 when housing 6 is in its latching position. Release actuator 12 retracts temporarily into sole plate 1 disengaging the wall of recess 8 and tip 13 upon generation of an electrical release signal. Housing 6 is then free to move to its releasing position under the influence of moment 11.

Figure 3:
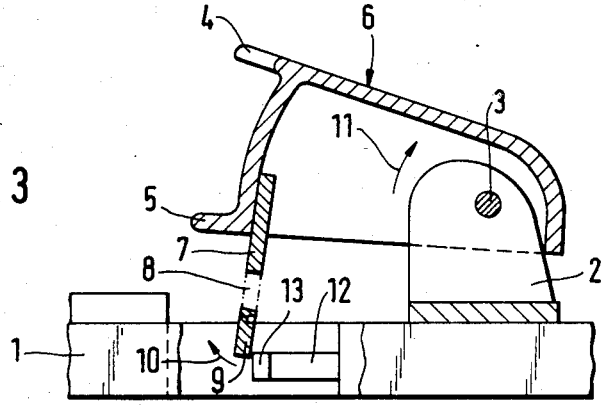
FIG. 3 is a cross sectional side view of an embodiment of a heel piece, according to the invention, after release of the release actuator.

As best shown in FIG. 3, housing 6 is moved against the force of moment 11 to latch housing 6 in its latching position and to cock release actuator 12 at the same time. As housing 6 is moved, counterclockwise in FIG. 3, extension 9 of plate 7 presses against release actuator 12 pushing it to the right against a biasing force acting toward the left. The continued movement of housing 6 results in the alignment of tip 13 and recess 8 so that actuator 12 is projected into recess 8 to latch housing 6 in its latching position. In that way actuator 12 is cocked for actuation upon receipt of a releasea signal. The extent of the projection is limited by the configurations of tip 13 and recess 8. As shown in FIG. 2, tip 13 preferably has an L shape and recess 8 includes a complementary receiving shape for positive engagement of the tip and recess.

Figure 4:
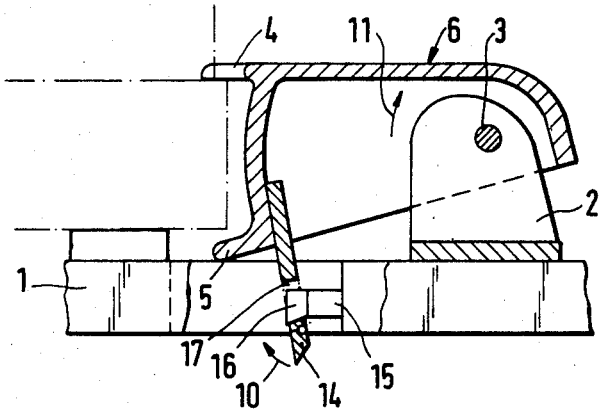
FIG. 4 is a cross sectional side view of an embodiment of a heel piece, according to the invention, in its latching position.
Figure 5:
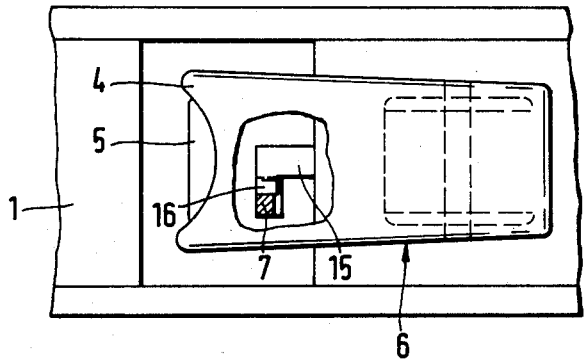
FIG. 5 is a top view, partially sectioned, of an embodiment of a heel piece, according to the invention, in its latching position.
Figure 6:
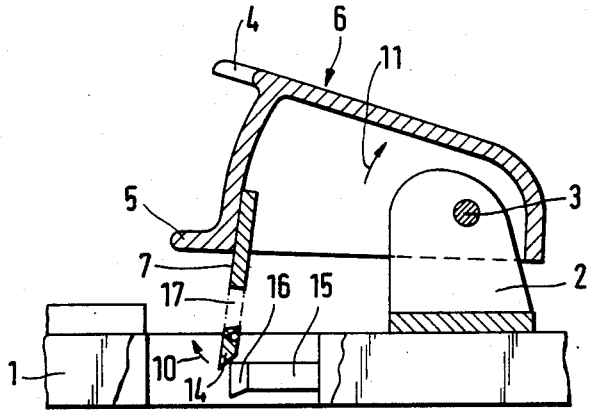
FIG. 6 is a cross sectional side view of an embodiment of a heel piece, according to the invention, after release of the release actuator.

FIGS. 4, 5, and 6 show an embodiment like that of FIGS. 1, 2 and 3 except for the configurations of the tip of the release actuator and the plate. In those figures, plate 7 has an extension 14 which includes a lower surface oblique to the plate. The lower surface engages a release actuator 15 when housing 6 is moved toward its latching position and pushes the actuator toward sole plate 8 to cock it. The oblique surface reduces the amount of surface contact, and therefore the amount of friction, between plate 7 and actuator 15 when housing 6 is moved to its latching position. This arrangement achieves a reduction in the amount of force required to latch the binding, so that lighter weight skiers, such as children, may easily operate the binding. A tip 16 of release actuator 15 has a lower surface oblique to plate 7 and an aperture 17 in plate 7 includes a lower surface, likewise oblique. The oblique surface of tip 14 and aperture 17 bear on each other when housing 6 is its latching position. It is preferred that these surfaces be similarly angled so that they engage each other, as shown in FIG. 4, when the binding is in its latching position. The angles of the surfaces are also arranged, as shown in FIG. 4, so that the surface in aperture 17 restrains tip 16 against withdrawal into sole plate 1. That is, the engaged surfaces resist disengagement except when a release signal is generated causing actuation of release actuator 15. The oblique surfaces on the tip and aperture thereby improve the resistance of the embodiment to accidental release which could occur in response to mechanical shocks or vibrations experienced during skiing. In all respects not described in this paragraph, the embodiment of FIGS. 4, 5 and 6 is identical to that of FIGS. 1, 2 and 3.

A different embodiment of a heel piece according to the invention is shown in FIGS. 7 through 12. The elements shown in these figures which have been previously described and given reference numerals do not need to be described again. The embodiment pictured includes a housing 18 pivotally connected by axle 3 to support 2 mounted on sole plate 1. A release actuator 19 projects from sole plate 1 and bears on one end of a lever 20 which is pivotally connected along an axle 21 to sole plate 1. A lever biasing moment 22, shown acting counterclockwise in the figures, is placed on lever 20 by conventional means. Lever moment 22 ensures that lever 20 bears on release actuator 19 when housing 18 is in its latching and releasing positions. The end of lever 20 opposite actuator 19 includes a follower 23, which may be a pin or rod, for bearing on a guide 24. Guide 24 has a trapezoidal cross section and is mounted on the inside of housing 18. A housing biasing moment 22, shown acting clockwise in the figures, biases housing 18 to move toward its releasing position.

Figure 7:
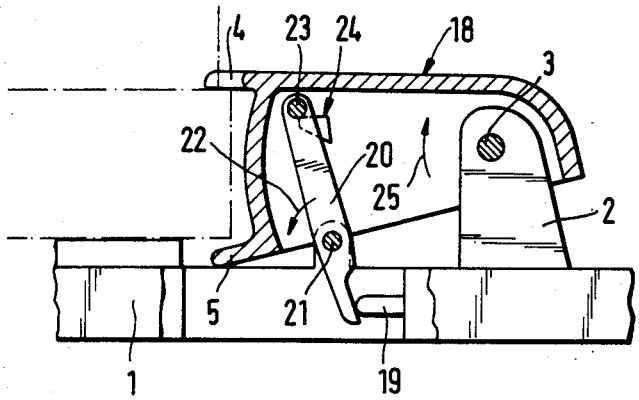
FIG. 7 is a cross sectional side view of an embodiment of a heel piece, according to the invention, in its latching position.
Figure 8:
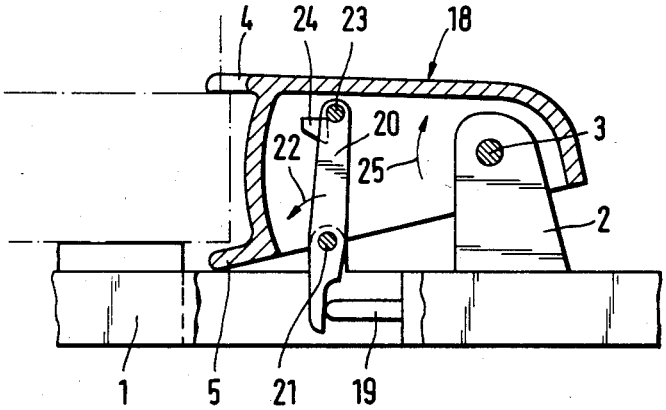
FIG. 8 is a cross sectional side view of an embodiment of a heel piece, according to the invention, immediately after release of the release actuator.
Figure 9:
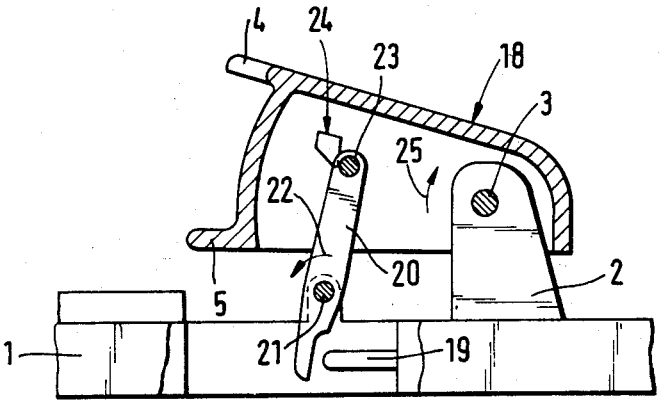
FIG. 9 is a cross sectional side view of an embodiment of a heel piece, according to the invention, after release of the release actuator.
Figure 10:
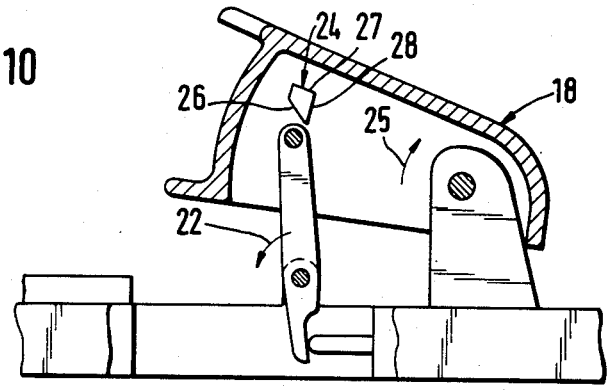
FIG. 10 is a cross sectional side view of an embodiment of a heel piece, according to the invention, in is releasing position.

In FIG. 7, the embodiment is shown in its latching position. One arm of lever 20 bears on release actuator 19. Follower 23 rests on the upper front corner of guide 24 which acts as a cam in guiding lever 20. In FIG. 8, the heel piece is shown immediately after the triggering of release actuator 19. The forward movement of actuator 19 causes lever 20 to rotate, clockwise in the figures, so that follower 23 traverses an upper surface 27 of guide 24. Once follower 23 passes surface 27 of guide 24 it no longer blocks movement of housing 18. Housing moment 25 then causes movement of housing 18 toward its released position. That movement is shown in FIG. 9. In FIG. 10, completion of movement toward the releasing position is shown. Follower 23 has passed along a rear surface 28 of guide 24 and has lost contact with guide 24. However, one end of lever 20 remains in contact with actuator 19 because of the urging of lever 29 by moment 22.

Figure 11:
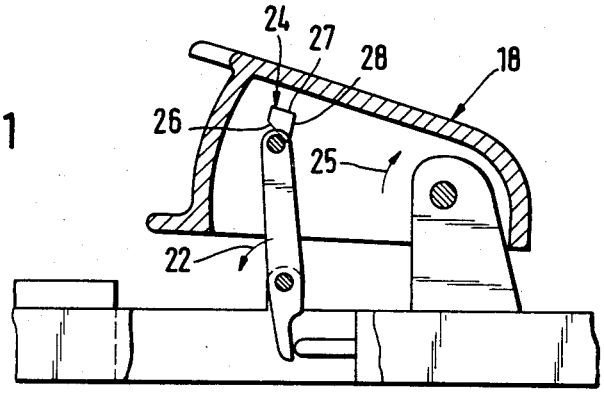
FIG. 11 is a cross sectional side view of an embodiment of a heel piece, according to the invention, beginning movement from its releasing position toward its latching position.
Figure 12:
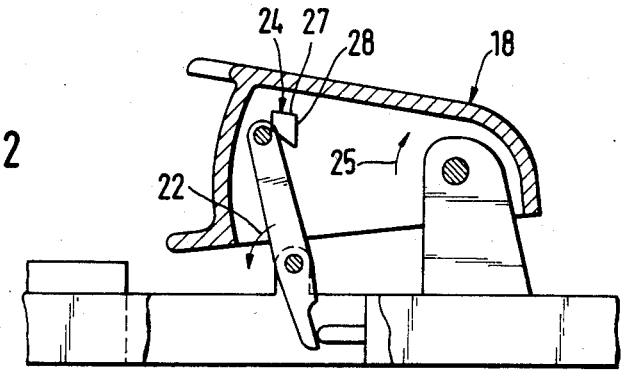
FIG. 12 is a cross sectional side view of an embodiment of a heel piece, according to the invention, near the end of movement from its latching position to its releasing position.

The process of moving housing 18 from its releasing position to its latching position is shown in FIGS. 11, 12 and 7. In FIG. 11, counterclockwise movement of housing 18 has begun, preferably driven by the force of the heel of a ski boot pressing on a foot pedal comprising protrusion 5 on housing 18. Follower 23 contacts an oblique lower surface 26 of cam 24. As housing 18 continues to move, follower 23 traverses surface 26 hich forces lever 20 to rotate counterclockwise against the force of lever moment 22. The rotation of lever 20 drives release actuator 19 into sole plate 1, cocking it as housing 18 is moved to its latching position. Once follower 23 traverses surface 26, it rides up the front surface of guide 24, as movement of housing 18 continues, reaching the upper front corner of guide 24. In that position, lever 20 is pivoted slightly by a biasing force on actuator 19. In its cocked position, the forward movement of actuator 19 is limited, so that lever 20 comes to rest, a shown in FIG. 7, with follower 23 on surface 27 of guide 24. In this latching position, follower 23 blocks guide 24 holding housing 19 toward sole plate 1, i.e., in its latching position. Lever moment 22 prevents follower 23 from moving rearward to release housing 18. The contact between lever 20 and release actuator 19 prevents follower 23 from moving forward to release housing 18.

An important advantage of the embodiment of FIGS. 7 through 12 is achieved through choosing the ratio of the lengths of the arms of lever 20 lying on opposite sides of axle 21. As shown in the figures, the length of the arm between actuator 19 and axle 21 is shorter than the arm from axle 21 to guide 24. As a result, the force applied to follower 23 by a ski boot engaging protrusion 5 is increased, in proportion to the ratio of the lengths of the lever arms, to a larger force which cocks actuator 19. This mechanical advantage reduces the force needed to latch the binding so that lightweight skiers may use the binding easily.

In the embodiments of the invention depicted in FIGS. 1 through 6, the release actuator retracts upon generation of a release signal. In the embodiments of FIGS. 7 through 12, the actuator is projected to accomplish a release. Electromechanical actuators with either action can be built with a solenoid having a slidable core. In the embodiment of FIGS. 1 through 6, the actuator is biased outwardly, but must be capable of being pushed back to latch the housing and of retracting upon generation of a release signal. In the embodiment of FIGS. 7 through 12, release actuator 19 is also biased outwardly. During cocking, actuator 19 is actually pushed inwardly beyond its cocked position, so that cocking may take place, and then allowed to extend slightly. Both of these constructions may be realized through use of known springs and detect mechanisms for biasing and latching the actuator.

Figure 13:
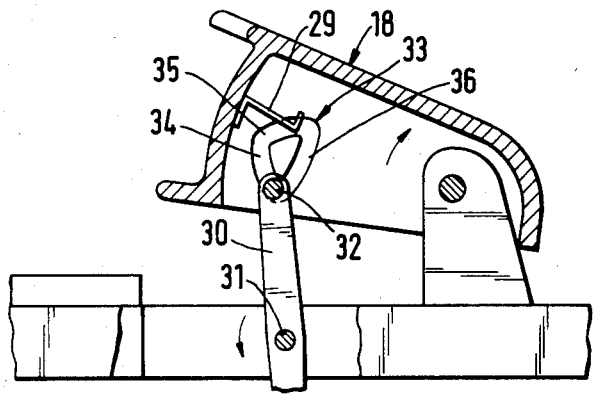
FIG. 13 is a cross sectional side view of an embodiment of a heel piece, according to the invention, in its releasing position.
Figure 14:
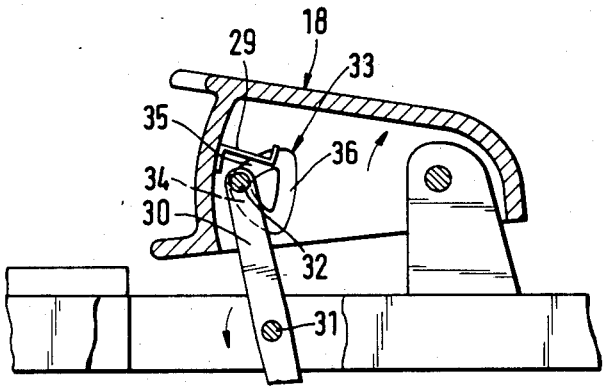
FIG. 14 is a cross sectional side view of an embodiment of a heel piece, according to the invention, beginning movement from its releasing position toward its latching position.
Figure 15:
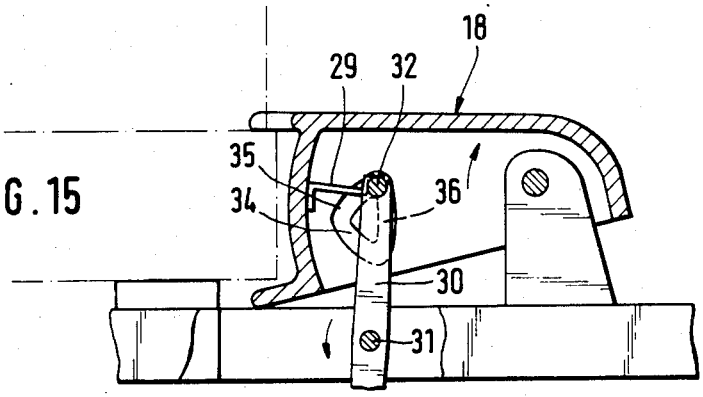
FIG. 15 is a cross sectional side view of an embodiment of a heel piece, according to the invention, in its latching position.

In FIGS. 13 through 15 another embodiment of a heel piece according to the invention and similar to that of FIGS. 7 through 12 is shown. A lever 30 is pivotally connected to sole plate 1 along an axle 31. One end of lever 20 includes a pin means 32 which is confined within a continuous groove or track 33 fixed to or engraved into housing 18. A stop 29 in the form of a leaf spring is attached to the inside of housing 18 and projects into a portion 35 of track 33. As before, housing 18 is biased to move toward its releasing position and lever 30 is biased about axle 31 in direction which is counterclockwise in the figures. Groove 33 which guides and limits the movement of lever 30 has, in the embodiment shown, three slightly convex portions forming the general shape of a spherical triangle. A portion 34 is the generally lower portion of the guide, a portion 35 is the generally forward portion and a portion 36 is the generally rearward portion. The portions are joined to form a continuous track. In the releasing position shown in FIG. 13, pin 32 rests near the junction of portions 34 and 36. As a ski boot drives housing 18 toward the latching position, pin 32 transverses portion 34. As the force of the boot continues to be exerted, pin 32 leaves portion 34 and enters portion 35, as shown in FIG. 14. When pin 32 reaches the free end of spring 29, spring 29 yields to allow pin 32 to pass, to the junction of portions 35 and 36, where the latching position is achieved as shown in FIG. 15. Spring 29 snaps back into position after pin 32 passes and acts as a stop preventing pin 32 from slipping back into portion 35 and moving in a reverse direction. As shown in FIGS. 13 through 15, the forward and only permitted direction of movement of pin 32 in groove 33 is clockwise. Pin 32 does not travel down portion 36 because of the lever biasing moment exerted on lever 30 which drives pin 32 against spring 29. Upon generation of a release signal, lever 30 is rotated clockwise, as viewed in the figures. (The release actuator is not shown in FIGS. 13 through 15, but could be similar to that of FIGS. 7 through 12.) Once pin 32 starts down portion 36, in response to the release actuation and housing biasing moment, that moment drives housing 18 to its releasing position as shown in FIG. 13.

Still another embodiment of the invention is shown in FIGS. 16 through 19. A lever 50 is pivotally mounted by an axle 42 to a support 39 mounted on sole plate 1. Support 39 also carries an axle 40 which is fixed to a housing 41 so that the housing may move from a latching position (shown in FIG. 16) to a releasing position (shown in FIG. 18). A housing biasing moment 43, clockwise in the figures, urges housing 41 to rotate toward its releasing position. A lever biasing moment 44, counterclockwise in the figures, biases lever 50. A lower arm 37 on lever 50 projects into a chamber within sole plate 1 in which a release actuator 38 is located. A pin 45, horizontal in the figures, projecting from the lower arm of lever 37 contacts actuator 38 when housing 41 is in its latching position through the influence of lever moment 44.

A doubly-hinged linkage also connects housing 41 and sole plate 1. A linkage support 46 is mounted on sole plate 1 and is pivotally connected to a first linkage arm 47. Linkage arm 47 is pivotally connected along an axle 48 to a second linkage arm 49. In turn, linkage arm 49 is pivotally connected to housing 41. Linkage arms 47 and 49 may be rotated relative to each other to close or fold in the manner of scissors. Axle 48 lies to the rear, or heel side, of linkage support 46. The upper portion of lever 50 includes a nose 51 and a recess 52 for receiving axle 48, bounded by nose 51 and an upper arm 53.

Figure 16:
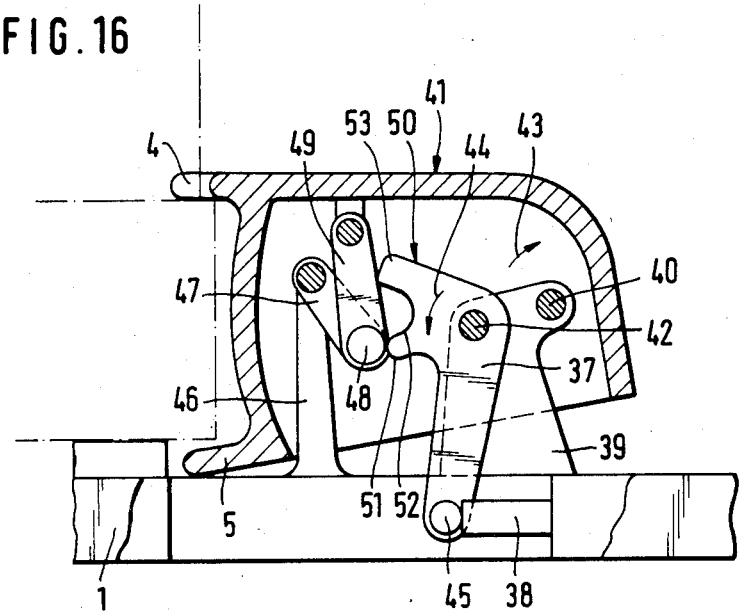
FIG. 16 is a cross sectional side view of an embodiment of a heel piece, according to the invention, in its latching position.

As seen in FIG. 16, when housing 41 is in its latching position, pin 45 bears on actuator 38 under the influence of lever biasing moment 44. Axle 48 is prevented from moving toward the heel end of the binding by its contact with nose 51 and lever 50. Therefore, linkage arms 47 and 49 remain folded and housing 41 is held down in its latching position when lever 50 is in the position shown in FIG. 16. Lever 50, particularly through nose 51, latches housing 41.

Figure 17:
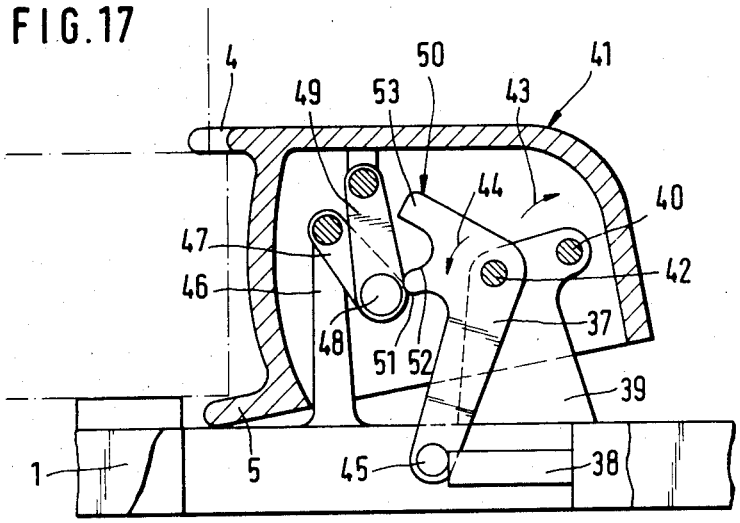
FIG. 17 is a cross sectional side view of an embodiment of a heel piece, according to the invention, immediately after release of the release actuator.

FIG. 17 shows the relative positioning of the elements of the embodiment just after the generation of a release signal which has thrown actuator 38 forward, toward the toe end of the binding. Actuator 38 pushes pin 45 so that lever 50 is rotated about axle 42, clockwise in FIG. 17, thereby raising nose 51 so that it is removed from block axle 48. Axle 48 is then raised and linkage arms 47 and 49 unfold under the influence of housing biasing moment 43.

Figure 18:
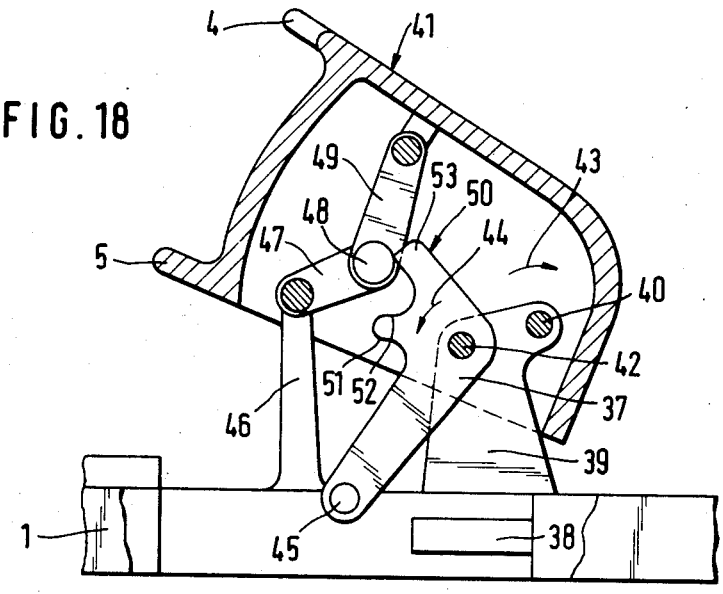
FIG. 18 is a cross sectional side view of an embodiment of a heel piece, according to the invention, in its releasing position.

As axle 48 rises, the position of FIG. 18 is achieved with the binding in its releasing position. Axle 48 engages upper arm 53 of lever 50 causing further clockwise rotation of lever 50 as viewed in FIG. 18.

Figure 19:
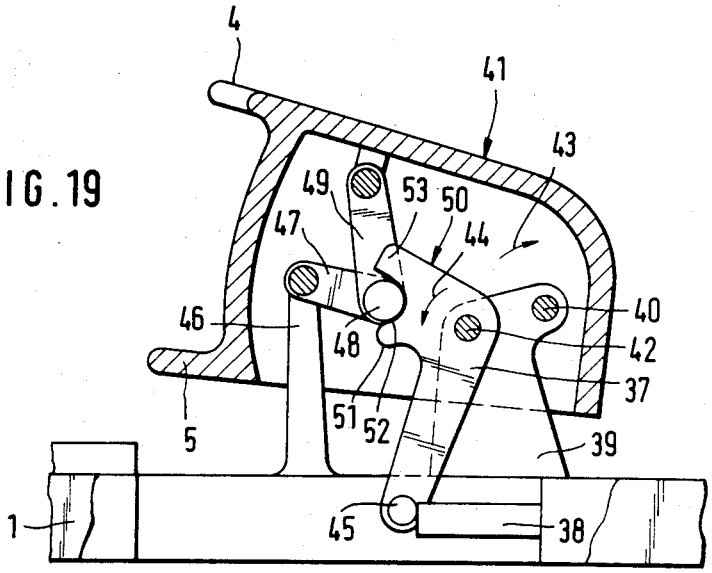
FIG. 19 is a cross sectional side view of an embodiment of a heel piece, according to the invention, beginning movement from its releasing position toward its latching position.

From the releasing position of FIG. 18, the binding is driven through the position of FIG. 19 before it reaches the latching position of FIG. 16. The heel of a ski boot, not shown, engages housing protrusion 5 as a pedal and drives it toward sole plate 1. As housing 41 is rotated about axle 40, counterclockwise in FIG. 19, axle 48 disengages from upper arm 53 of lever 50. Because of the rearward force on axle 48 the axle is pushed into recess 52 which receives and retains axle 48 to drive the cocking of actuator 38. Axle 48 is held in recess 52 by nose 51. As a result, the movement of housing 41 causes rotation of lever 50, counterclockwise in FIG. 19. Pin 45 is thereby brought into contact with actuator 38 driving it backward into base plate 1 so that it is cocked. As described for other embodiments, actuator 38 is pushed into sole plate 1 somewhat beyond the position at which it is latched and is allowed to extend slightly upon complete latching of the binding. Once the latched position of actuator 38 has been achieved, recess 52 is sufficiently tilted downward to allow axis 48 to slide out of the recess and engage nose 51 as shown in FIG. 16. Therefore, the linkage between sole plate 1 and housing 41 bearing on lever 50, and particularly employing recess 52 of lever 50, acts as a cocking means for cocking actuator 38 when housing 41 is moved to its latching position.

Figure 20:
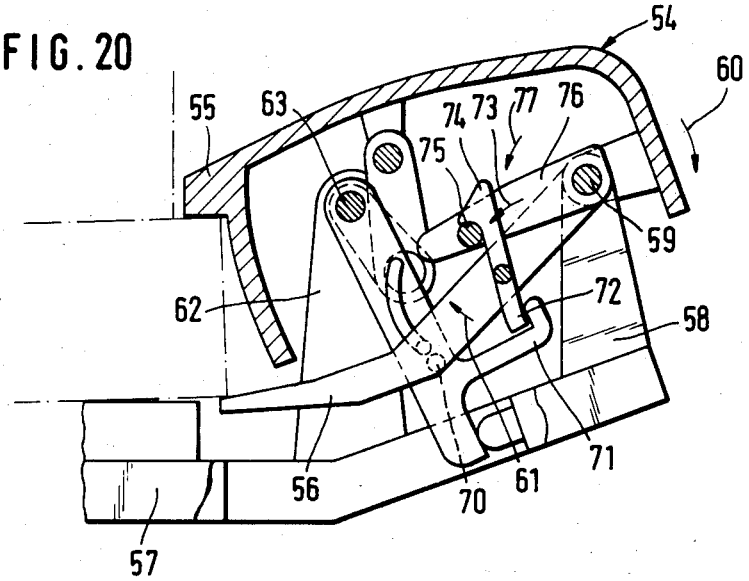
FIG. 20 is a cross sectional side view of an embodiment of a heel piece, according to the invention, in its latching position.

A different embodiment of the inventive binding, related to the one just described, is shown in FIGS. 20 through 23. This embodiment includes an angled sole plate 57 that is sloped upwardly, away from a ski, near the heel end of the binding. In FIG. 20, the binding is shown in its latching postion. Many of its elements are best viewed and numbered in FIGS. 22 and 23. A housing 54 includes a protrusion 55 on its forward surface for engaging the top of the heel portion of the sole of a ski boot and restraining it towards the ski when housing 54 is in its latching position. A support 58 mounted on sole plate 57 near the heel end of the binding includes an axle 59 on which housing 54 is pivotally connected. A heel lever 56 is also pivotally mounted on axle 59. Heel lever 56 extends forward beyond housing 54 for receiving the sole of a ski boot, shown in broken lines in FIG. 20. Heel lever 56 is a pedal which the sole of a ski boot drives to move housing 54 from its releasing position (shown in FIG. 22) to its latching position. A housing biasing moment 60 is applied to housing 54 by conventional means, such as a spring, for urging housing 54 to move toward its releasing position, clockwise in FIG. 20. A heel lever biasing moment 61 is applied to heel lever 56 by conventional means to move heel lever 56 against the sole of a ski boot, counterclockwise in FIG. 20. A second support 62 is mounted on sole plate 57 near the forward or toe end of housing 54. An axle 63 mounted in support 62 pivotally connects sole plate 57 with a release lever 64 (numbered in FIG. 23) which bears at its lower end on a release actuator 66 located in a chamber with sole plate 57. A release lever biasing moment 65 is applied by conventional means to release lever 64 in a direction, counterclockwise in FIG. 22, to maintain contact between lever 64 and actuator 66. An arcuate track or guide 67 is pivotally connected at its lower end to release lever 64. A track biasing moment 68, applied by conventional means, tends to rotate track 67 toward the heel end of the binding, counterclockwise in FIG. 22. Pivoting of track 67 is limited by a stop 69 mounted on release lever 64 near the pivotal connection of track 67 to lever 64.

Heel lever 56 includes a follower 70, which may be a pin, for bearing on track 67 when housing 54 is moved to its latching position. The bearing of pin 70 on guide 67 ensures that downward movement of heel lever 56 pivots release lever 64 toward the heel of the binding. That movement of release lever 64 pushes cockable release actuator 66 back into sole plate 57 to cock it. A catch release 71 extends rearwardly from release lever 64 for engaging a lower end 72 of a pivoting catch 74. Catch 74 is pivotally mounted on heel lever 56 and includes at its end opposite end 72 a hook for engaging a catch retainer 75. A catch moment 73 is applied to catch 74 by conventional means to urge engagement of catch 74 and retainer 75. Retainer 75 is mounted on a finger 76 which is pivotally mounted on axle 59 and is under the influence of a finger moment 77 which urges finger 75 toward sole plate 57, counterclockwise in FIG. 20. The distal end of finger 76 bears upon a linkage like that of FIGS. 16 through 19 and given the same reference numerals. That linkage includes a link 47 pivotally connected along axle 63 to sole plate 57 and pivotally connected to an axle 48 lying to rear or heel direction of the binding in reference to support 62. A link 49 is pivotally connected to axle 48 and to housing 54 to allow housing 54 to move between its latching and releasing positions.

In FIG. 20, the embodiment is shown in its latching position. A ski boot shown in broken lines bears on heel lever 56. Skiing forces that tend to raise housing 54 toward its releasing position are positively resisted. Such forces, which tend to move housing 54, counterclockwise in FIG. 20, cause axle 48 to move toward the heel end of the binding. But such movement is prevented by finger 76 and the engagement of catch 74 on retainer 75 holding finger 76 downward. Therefore, the binding remains in such latching position. Also, follower 70 is blocked from upward movement by guide 67.

Figure 21:
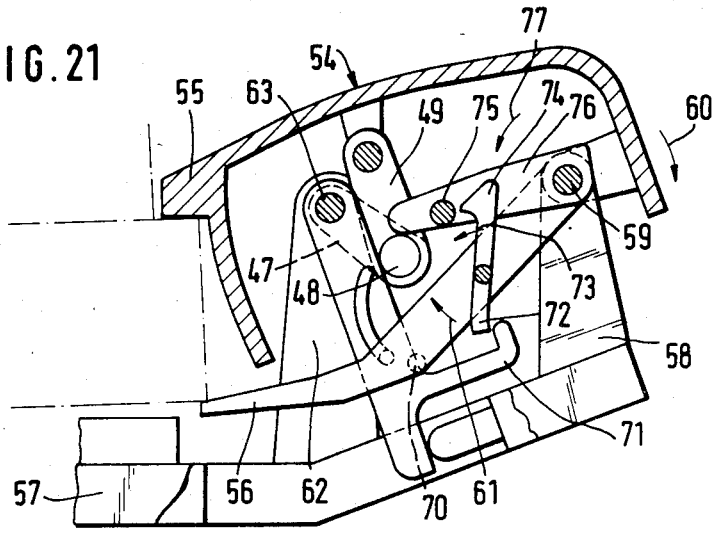
FIG. 21 is a cross sectional side view of an embodiment of a heel piece, according to the invention, immediately after release of the release actuator.

The instant after the generation of a release signal is shown in FIG. 21. Release actuator 66 has been thrown forward to the toe end of the binding. Actuator 66 pushes release lever 64 so that it pivots. Pivoting of release lever 64 in turn moves catch release 71 which pivots catch 74 so that retainer 75 is released. Finger 76 can then be pushed upwardly by axle 48 to allow housing 54 to begin movement toward its releasing position. The pivoting of release lever 64 removes guide 67 from blocking follower 70, so that it may pass by the guide on the heel side of the binding.

Figure 22:
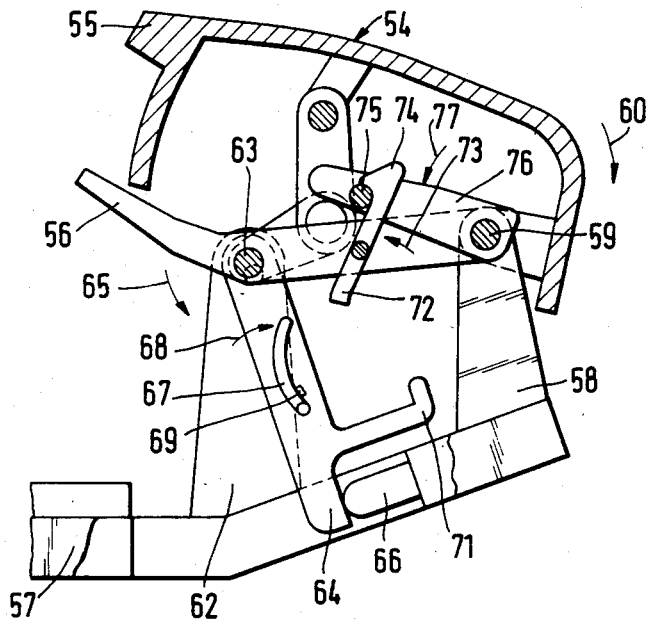
FIG. 22 is a cross sectional side view of an embodiment of a heel piece, according to the invention, in its releasing position.

The end of the movement to the releasing position is shown in FIG. 22. Housing 54 has pivoted under the influence of housing moment 60 and links 47 and 49 have unfolded. Heel lever 56 has raised from sole plate 57 under the influence of moment 61 allowing catch 74 to pass by and to again engage retainer 75 under the influence of moment 73. Finger 76 continues to contact axle 48, lying on top of it, rather than blocking it from the side as in FIG. 20. The contact is maintained through the urging of moment 77. Release lever moment 65 maintains contact between release lever 46 and release actuator 66.

Figure 23:
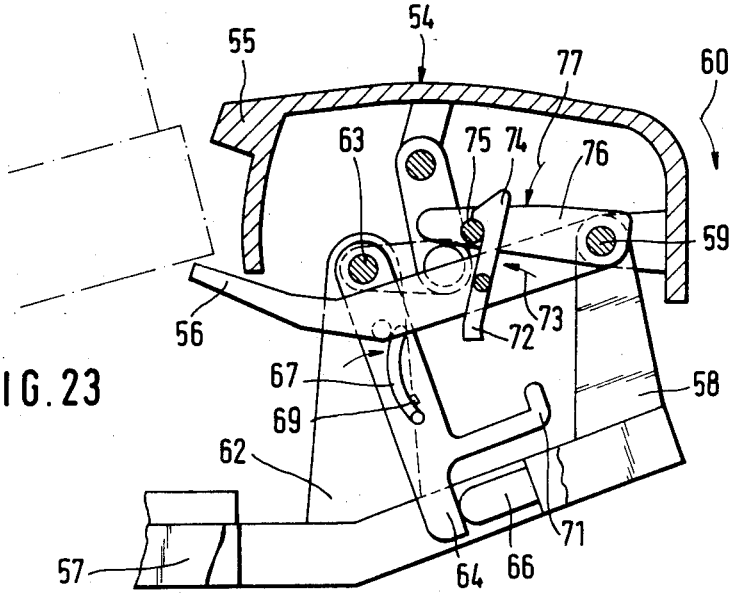
FIG. 23 is a cross sectional side view of an embodiment of a heel piece, according to the invention, beginning movement from its releasing position toward its latching position.

In FIG. 23, the embodiment of the binding is shown being driven from its releasing to its latching position to latch the binding and cock the release a actuator. The heel of a ski boot presses on heel lever 56 forcing it downward toward sole plate 57 so that follower 70 bears upon guide 67. Since catch 74 is engaged, the same driving force pulls finger 76 downward, which in turn, pulls axle 48 down. The bearing of follower 70 on guide 67 serves to keep heel lever 56 projecting from housing 54 and to push, through release lever 64, on actuator 66. As described for other embodiments, actuator 66 is pushed back into sole plate 57, beyond its cocked position so that it may latch, and then extend forward slightly. The downward motion of heel lever 56 thus drives the elements of this embodiment back to the positioning shown in FIG. 20, i.e., the latching position of the binding, in which finger 76 blocks axle 48 from the side and end 72 of catch 74 is aligned with catch release 71 of release lever 64.

Figure 24:
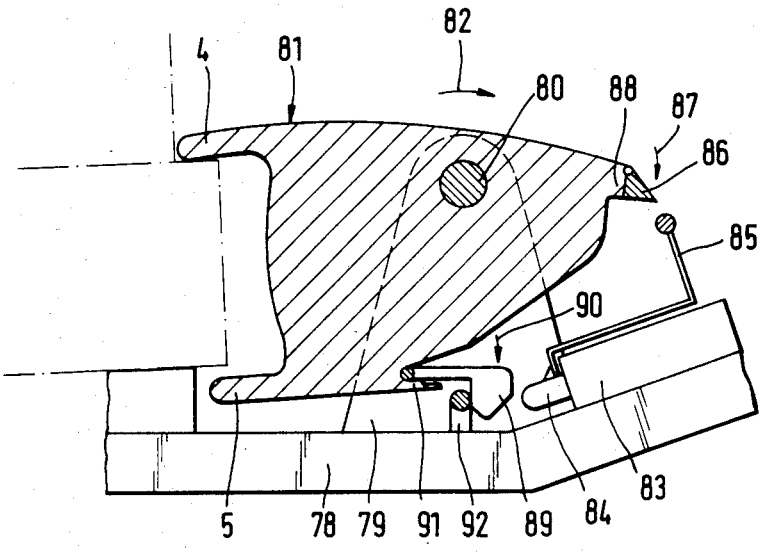
FIG. 24 is a cross sectional side view of an embodiment of a heel piece, according to the invention, in its latching position.
Figure 25:
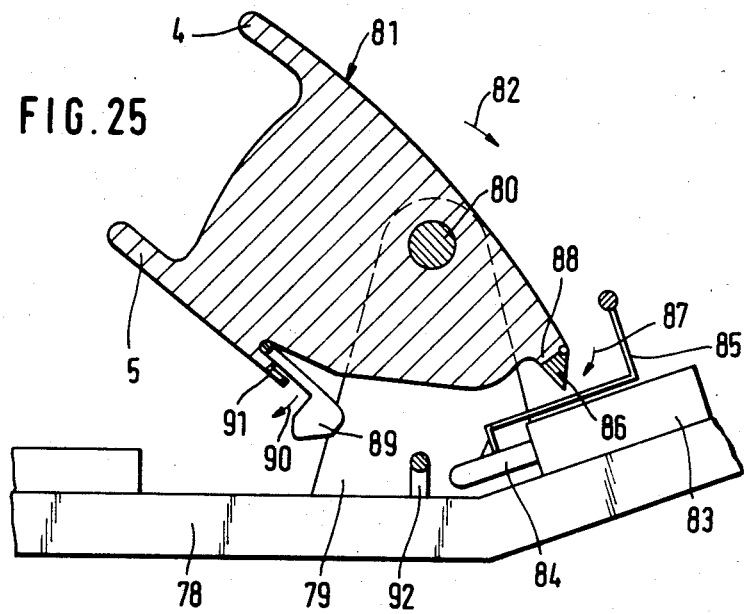
FIG. 25 is a cross sectional side view of an embodiment of a heel piece, according to the invention, in its releasing position.
Figure 26:
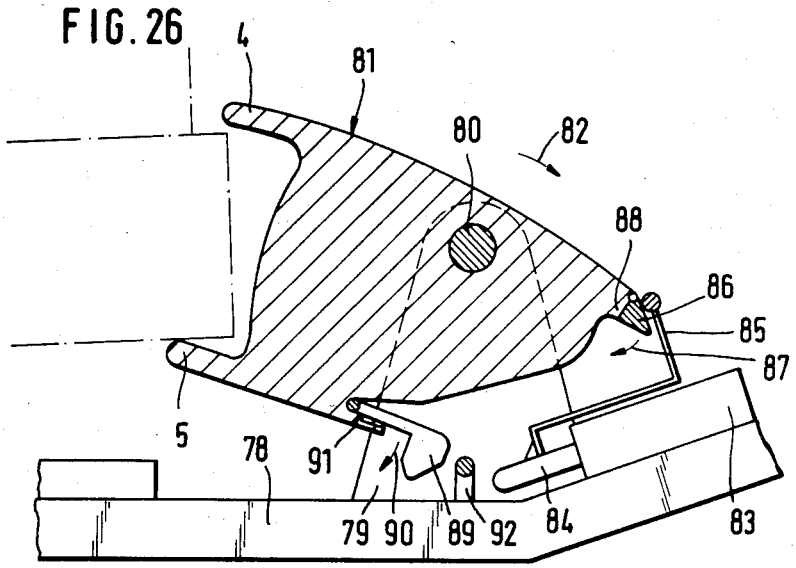
FIG. 26 is a cross sectional side view of an embodiment of a heel piece, according to the invention, beginning movement from its releasing position toward its latching position.

A final embodiment of the inventive binding is shown in FIGS. 24 through 26. Again the sole plate 78 is angled upwardly at the heel end of the binding. A support 79 is mounted on plate 78 and includes an axle 80 to which a housing 81 is pivotally mounted. Housing 81 includes, as shown in other embodiments, protrusions 4 and 5 on its forward surface for receiving the heel of the sole of a ski boot shown in FIG. 24. Protrusion 5 functions as a pedal which the sole of the ski boot drives when moving housing 81 to its latching position from its releasing position. A housing biasing moment 82, which may be exerted by conventional means such as a spring, urges housing 82 toward its releasing position.

A release actuator housing 83 is located at the rear end of the binding and housing a release actuator 84, and the mechanism which latches and propels actuator 84. A cocking arm 85 is attached to actuator 84, extends along housing 83 and has an upstanding portion projecting toward housing 81. Housing 81 includes at its top rearmost portion a tip 86 for driving cocking arm 85 when housing 81 is moved to its latching position, as hereinafter described. Preferably, tip 86 is pivotally connected to housing 81 along an axle located at the top of housing 81 where it joins tip 86. A tip moment 87, clockwise in the figures, urges tip 86 into contact with housing 81 at a rearward protrusion 88 of housing 81 which acts as a stop for tip 86.

A hook 89 protrudes from housing 81, to which it is attached. Hook 89 lies between housing 81 and sole plate 78. Hook 89 includes an elongated neck portion 93 and a larger retaining portion 94. Retaining portion 94 is biased downwardly, toward sole plate 78 by a moment 90, clockwise in the figures, applied by conventional means. If, as is preferred, hook 89 is formed from a resilient material, such as a plastic, its natural flexing or tempering may supply moment 90. Hook 89 is preferably embedded in a notch in housing 81 formed by an extension 91 of housing 81. A post means 92 projects from sole plate 78, beneath axle 80. Post means 92 may be a post or preferably, as shown, an inverted U-shaped rod affixed to sole plate 78. Hook 89 is hooked over post 92 when housing 81 is in its latching position as shown in FIG. 24.

On its underneath side, the side toward sole plate 78, hook 89 includes two oppositely sloped surfaces. A surface 95 on retaining portion 94, toward release actuator 84, is angled like sole plate 78 so that when actuator 84 pushes on that surface, hook 89 is lifted away from sole plate 78. Hook 89 may then escape post 92 under the influence of housing moment 82 which urges housing 81 toward its releasing position. An oppositely angled surface 96 on retaining portion 94 lies forward of surface 95. When housing 81 is moved toward its latching position, surface 96 engages post 92 which tends, through the slope of surface 96, to raise retaining portion 94 away from sole plate 78. This lifting aids in reaching the latching position shown by reducing the force necessary to push retaining portion 94 beyond post 92.

In FIG. 25, the embodiment of the binding is shown in its releasing position. Upon generation of a release signal, actuator 84 is thrown forward lifting hook 89 up and over post 92, as previously explained. Housing 81 pivots and ski boot is released from the binding. The hinged attachment of tip 86 to housing 81 prevents an interference between tip 86 and cocking arm 85 during a binding release. Should those parts contact each other during pivoting of housing 81, tip 86 pivots out of the path allowing the elements to continue their relative motion. When actuator 84 is thrown forward it carries with it cocking arm 85.

The cocking of release actuator 84 is illustrated in FIG. 26. The heel of a ski boot engages protrusion 5 of housing 81 moving it towards it latching position. As housing 81 moves, surface 96 of hook 89 contacts post 92. The sloping surface causes hook 89 to ride up and over post 92 under the influence of the driving force of the ski boot, latching the hook and post. At the same time, tip 86 engages the upstanding portion of cocking arm 85. The figures show a rod or ball on the top of arm 85 to stiffen it. As will be appreciated by those skilled in the art, arm 85 must be strong enough to accept the cocking forces applied by tip 86. Tip 86 drives arm 85 rearward so that actuator 84 is drawn back into housing 83 where it is latched in its cocking position. Tip 86 and arm 85 are arranged so that sufficient displacement of arm 85 takes place during movement of housing 81 to its latching position to cock release actuator 84. After actuator 84 is cocked, the engagement of tip 86 and arm 85 ends and the elements of the binding take up the relative positions shown in FIG. 24.

The invention has been described with reference to certain preferred embodiments. Various additions, modifications and substitutions within the spirit of the invention will occur to one of skill in the art. Therefore the scope of the invention is limited solely by the following claims.

I claim:

1. An electronic safety ski binding for releasably latching a ski boot, said binding comprising:

a sole plate;

a release actuator movable between a cocked position and an actuating position, said actuator responsive to an electrical release signal;

a housing movable between latching and releasing positions, said housing including protrusions for receiving and engaging the sole of a ski boot, one of said protrusions engageable by a boot for moving said housing means from the releasing to the latching position;

a linkage for connecting said sole plate and said housing wherein said linkage comprises a first linkage arm connected to said sole plate, a second linkage arm connected to said housing and an axle interconnecting said first and second linkage arms, and a latching lever, pivotally connected to said sole plate, including a recess, a nose portion, and an actuator engaging portion, said recess for receiving and engaging said axle during movement of said housing from the releasing position to the latching position, said engagement effecting rotation of said lever wherein said actuator engaging portion moves said release actuator to the cocked position;

said release actuator releasably retaining said lever in a cocked condition wherein said nose portion bears on said axle to hold said housing in the latching conditionand rotating said lever to release said nose from engagement with said axle and allow said housing to move to the releasing condition in response to movement of said release actuator to the actuating position upon receiving said electrical signal.

2. The invention according to claim 1 and further comprising connecting means for pivotally mounting said housing means on said sole plate means.

* * * * *

UNITED STATES PATENT AND TRADEMARK OFFICE

CERTIFICATE OF CORRECTION

PATENT NO. : 4,657,278

DATED : April 14, 1987

INVENTOR(S) : Gerd Klubitschko

It is certified that error appears in the above—identified patent and that said Letters Patent is hereby corrected as shown below:

On the cover sheet, the following information regarding the assignment of the patent is missing:

"Assignee: Marker International, Salt Lake City, UTAH"

On the cover sheet, the following information regarding the attorney of record is missing:

"Attorney, Agent or Firm: D. Peter Hochberg"

Signed and Sealed this

Twenty-sixth Day of January, 1988

*Attest:*

*Attesting Officer*

DONALD J. QUIGG

*Commissioner of Patents and Trademarks*